US005931526A

United States Patent [19]

Tseng

[11] Patent Number: 5,931,526

[45] Date of Patent: Aug. 3, 1999

[54] CHAIR FRAME WITH AN ADJUSTABLE BACKREST FRAME

[75] Inventor: Chuen-Jong Tseng, Chiayi Hsien, Taiwan

[73] Assignee: Shin Yen Enterprise Co., Ltd., Taiwan

[21] Appl. No.: 09/097,017

[22] Filed: Jun. 12, 1998

[51] Int. Cl.[6] ..... A47C 4/00

[52] U.S. Cl. ..... 297/27; 297/35; 297/31; 297/377; 297/359

[58] Field of Search ..... 297/27, 28, 35, 297/31, 16.1, 377, 378.1, 378.12, 359, 354.12

[56] References Cited

U.S. PATENT DOCUMENTS

| | | |
|---|---|---|
| 2,097,500 | 11/1937 | Oermann . |
| 2,638,970 | 5/1953 | Harber . |
| 2,776,704 | 1/1957 | Moore et al. . |
| 2,812,013 | 11/1957 | Kreciglowa . |
| 4,474,407 | 10/1984 | Nazar . |
| 4,514,009 | 4/1985 | Vanderminden et al. . |
| 5,282,664 | 2/1994 | Tseng . |
| 5,310,246 | 5/1994 | Tseng . |
| 5,613,737 | 3/1997 | Tseng . |

*Primary Examiner*—Milton Nelson, Jr.
*Attorney, Agent, or Firm*—Ladas & Parry

[57] ABSTRACT

A chair frame includes a backrest frame, a seat frame pivoted to the backrest frame about a first pivot axis, and a rear leg frame extending downwardly from the rear end portion of the seat frame. A regulating seat is mounted on the rear leg frame and has two opposite side walls that define an elongated slot therebetween. One of the side walls is formed with a plurality of engaging grooves that open toward the elongated slot. An armrest frame has a front section extending forwardly of the backrest frame, and a rear section that extends rearwardly and downwardly of the backrest frame and that is pivoted to the backrest frame about a second pivot axis above the first pivot axis. The armrest frame is provided with an engaging member that extends slidably into the elongated slot for engaging a selected one of the engaging grooves. The armrest frame is operable to move the engaging rod between a first position, in which the engaging member is movable along the elongated slot to permit forward and rearward pivoting movement of the backrest frame about the first pivot axis, and a second position, in which the engaging member engages the selected engaging groove to support the backrest frame at a desired inclination relative to the seat frame.

5 Claims, 6 Drawing Sheets

CHAIR FRAME WITH AN ADJUSTABLE BACKREST FRAME

BACKGROUND OF THE INVENTION

1. Field of the Invention

This invention relates to a chair frame, more particularly to a chair frame which has a backrest frame that can be easily adjusted.

2. Description of the Related Art

A leisure chair, such as a foldable chair, having an angle-adjustable backrest is known in the art. FIG. 1 illustrates a foldable chair 1 which includes first and second frames 11, 12 that are pivoted to one another at intermediate sections thereof to form an X-shaped configuration. The first frame 11 has a front section which extends forwardly of the second frame 12 to serve as a seat frame 111, and a rear section which extends rearwardly of the second frame 12 to serve as a rear leg frame 112. The second frame 12 has an upper section which extends upwardly of the first frame 11 to serve as a backrest frame 121, and a lower section which extends downwardly of the first frame 11 to serve as a front leg frame 122. A piece of cloth 13 extends from the backrest frame 121 to the seat frame 111 to form a seat portion and a backrest portion. A regulating unit 2 is provided on the backrest frame 121 and the rear leg frame 112 to regulate the inclination of the backrest frame 121 relative to the seat frame 111. The regulating unit 2 includes a U-shaped support rod 21 disposed posteriorly of the backrest frame 121 and pivoted to the backrest frame 121, and a pair of regulating blocks 22 which are fixed to the rear leg frame 112. Each of the regulating blocks 22 is formed with a plurality of engaging grooves 221 for engaging the support rod 21 to support the backrest frame 121 at a desired inclination. To adjust the inclination of the backrest frame 121, the user must stand up from the chair 1 to disengage the support rod 21 from an initial pair of aligned engaging grooves 221 of the regulating blocks 21 and permit movement of the support rod 21 to engage another pair of the aligned engaging grooves 221. Although the conventional foldable chair 1 permits both folding of the chair 1 and adjustment of the inclination of the backrest frame 121, the adjustment operation is not convenient for the user.

SUMMARY OF THE INVENTION

The main object of the present invention is to provide a chair frame having a backrest frame that can be adjusted while the user is seated thereon.

Accordingly, the chair frame of the present invention includes a backrest frame having a lower end portion, a substantially horizontal seat frame having a rear end portion pivoted to the lower end portion of the backrest frame about a first pivot axis, a rear leg frame extending downwardly from the rear end portion of the seat frame, and a front leg frame extending downwardly from a front end portion of the seat frame. The chair frame further includes a regulating seat mounted on the rear leg frame, and a movable armrest frame. The regulating seat has two opposite side walls that define an elongated slot therebetween. One of the side walls is formed with a plurality of engaging grooves that open toward the elongated slot. The armrest frame has a front section that extends forwardly of the backrest frame, and a rear section that extends rearwardly and downwardly of the backrest frame and that is pivoted to the backrest frame about a second pivot axis above the first pivot axis. The rear section of the armrest frame is provided with an engaging member that is disposed adjacent to the rear leg frame and that extends slidably into the elongated slot of the regulating seat for engaging a selected one of the engaging grooves. The armrest frame is operable to move the engaging rod between a first position, in which the engaging member is movable along the elongated slot to permit forward and rearward pivoting movement of the backrest frame about the first pivot axis, and a second position, in which the engaging member engages the selected one of the engaging grooves to support the backrest frame at a desired inclination relative to the seat frame.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
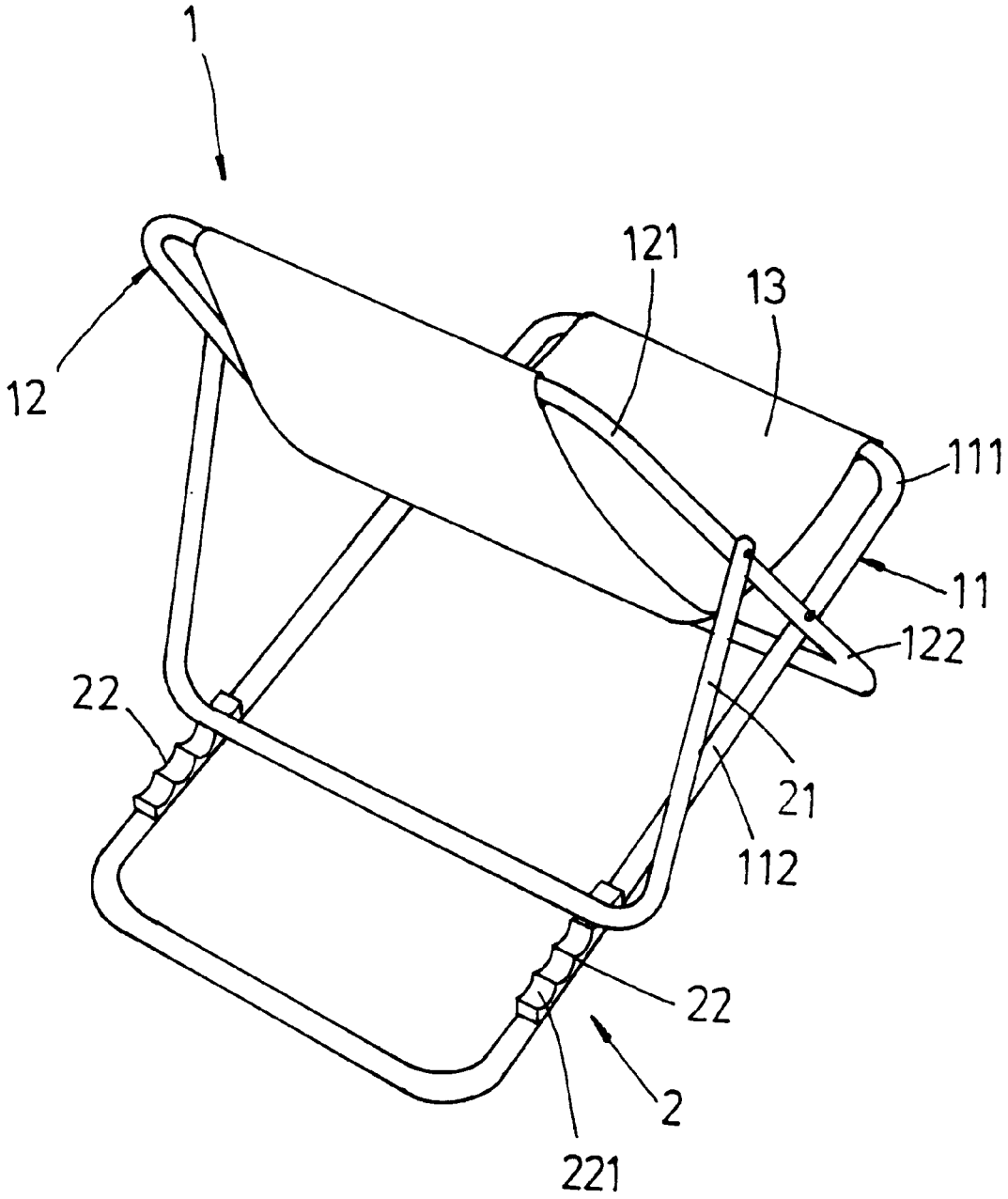
FIG.1 PRIOR ART
FIG. 1 is a rear perspective view of a conventional foldable chair with an adjustable backrest frame.
Figure 2:
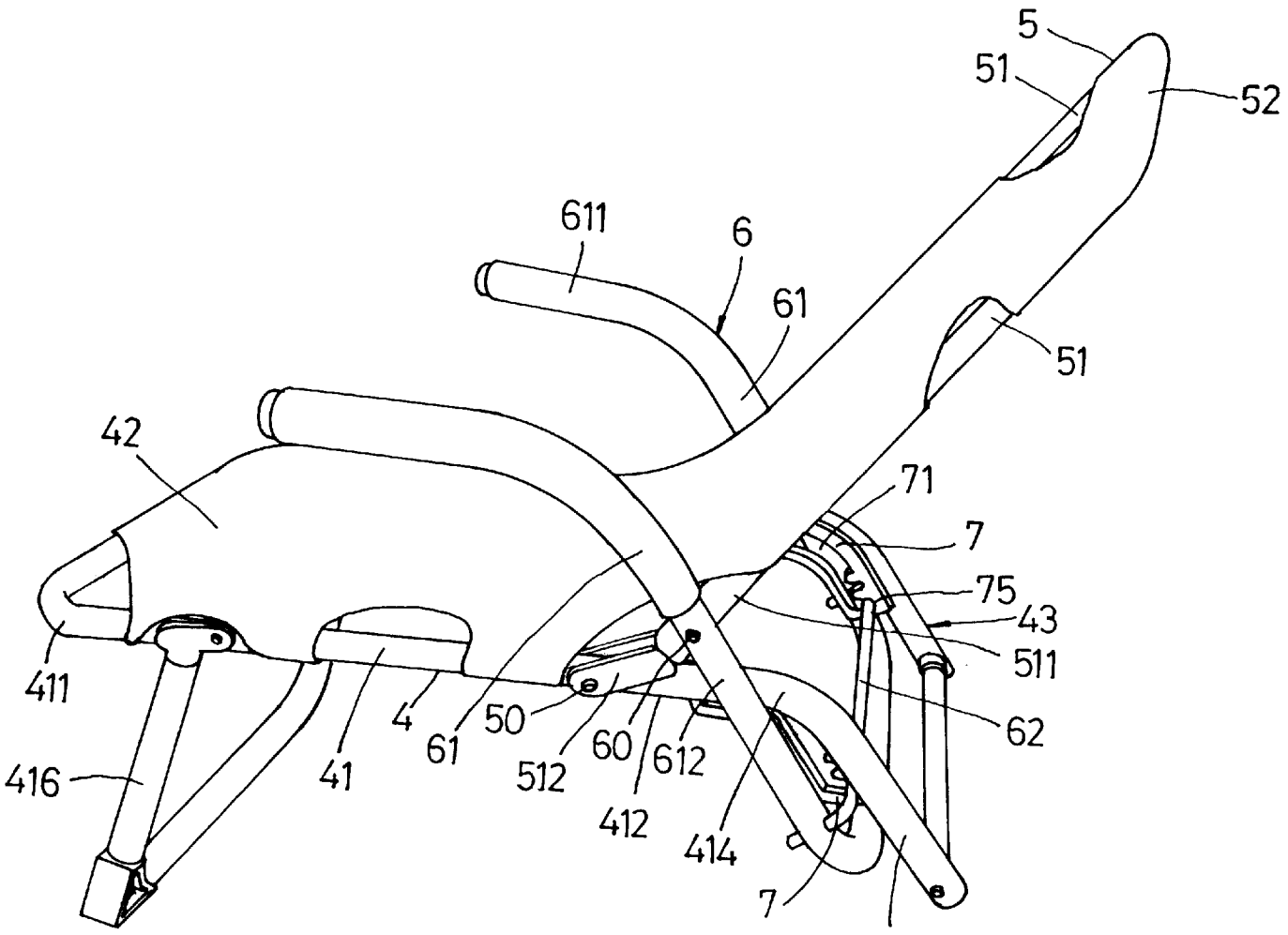
FIG. 2 is a perspective view of a preferred embodiment of a chair frame according to the present invention.
Figure 3:
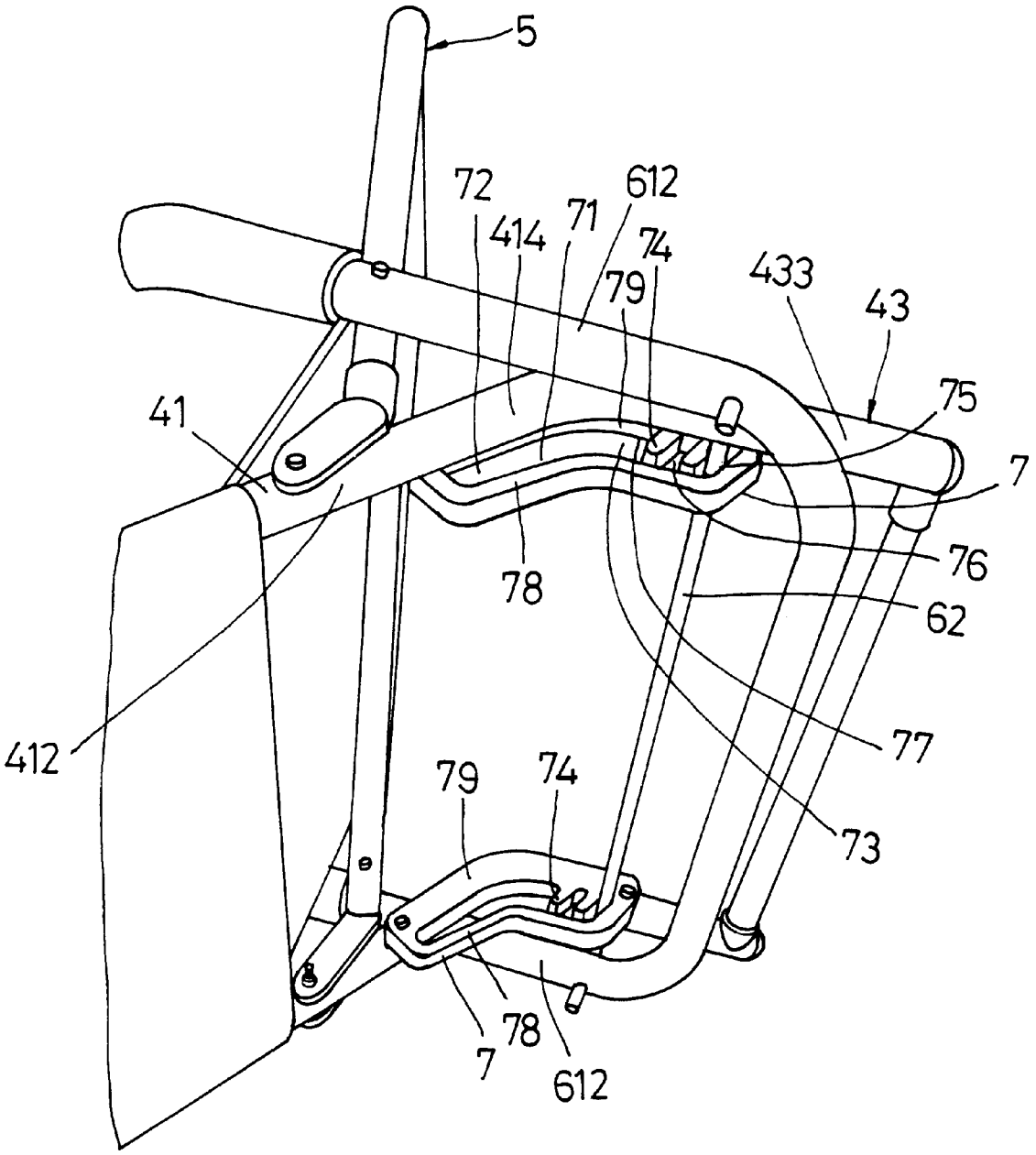
FIG. 3 is a fragmentary perspective view of the preferred embodiment when viewed from a bottom side thereof.

Referring to FIGS. 2 and 3, the chair frame of the preferred embodiment according to the present invention is shown to generally include a backrest frame 5, a substantially horizontal seat frame 4, a front leg frame 416, a rear leg frame 43, a movable armrest frame 6, and a pair of regulating seats 7.

The seat frame 4 is formed from a bent tube and includes a parallel pair of lateral rails 41, each of which has a front end portion 411 and a rear end portion 412.

The rear leg frame 43 includes two lateral posts 433, each of which extends downwardly and rearwardly from the rear end portion 412 of a respective one of the lateral rails 41 of the seat frame 4, and each of which has a curved front section 414 connected integrally to the rear end portion 412 of the respective lateral rail 41. The front leg frame 416 is formed into a U-shaped configuration and has upper ends mounted pivotally and respectively to the front end portions 411 of the lateral rails 41 of the seat frame 4 to permit folding of the front leg frame 416 relative to the seat frame 4.

The backrest frame 5 includes a parallel pair of lateral rods 51, each of which has a lower end portion 511 pivoted to the rear end portion 412 of a respective one of the lateral rails 41 of the seat frame 4 by means of a pair of pivot seats 512 (only one is shown) and about a first pivot shaft 50. A piece of cloth is mounted on the backrest frame 5 and the seat frame 4 to form a chair with a seat portion 42 and a backrest portion 52.

Each of the regulating seats 7 is fixed to an inner side of a respective one of the lateral posts 433 of the rear leg frame 43 at the curved front section 414. Each of the regulating seats 7 has a front side wall 78 and a rear side wall 79 which define an elongated slot 71 therebetween. The rear side wall 79 has a plurality of forward protrusions 74 to form a plurality of engaging grooves 75, 76, 77 which open toward the elongated slot 71. The engaging grooves 75, 76, 77 and the elongated slots 71 of the pair of regulating seats 7 are aligned respectively with one another. The elongated slot 71 of each of the regulating seats 7 includes a first section 72 which extends in a substantially horizontal direction along the lateral rails 41 of the seat frame 4, and a second section 73 which extends in a direction along the lateral posts 433 of the rear leg frame 43. The engaging grooves 75, 76, 77 are formed in the second section 73 of the elongated slot 71.

The armrest frame 6 includes a parallel pair of armrest bars 61 disposed on opposite sides of the backrest frame 5. Each of the armrest bars 61 includes a front section 611 which extends forwardly of the backrest frame 5, and a rear section 612 which extends rearwardly and downwardly of the backrest frame 5 and which is pivoted to the backrest frame 5 by means of a second pivot shaft 60 above the first pivot shaft 50. The armrest frame 6 is provided with an engaging member which is formed as a transverse engaging rod 62 that interconnects the rear sections 612 of the armrest bars 61 and that is disposed adjacent to and anteriorly of the rear leg frame 43. The transverse engaging rod 62 projects rearwardly relative to rear sides of the rear sections 612 of the armrest bars 61, and extends slidably into the elongated slots 71 of the regulating seats 7 for engaging a selected aligned pair of the engaging grooves 75, 76, 77. The armrest frame 6 is operable to move the transverse engaging rod 62 between a first position, in which the transverse engaging rod 62 is movable along the elongated slots 71 of the regulating seats 7 to permit forward and rearward pivoting movement of the backrest frame 5 relative to the seat frame 4 and about the first pivot shaft 50, and a second position, in which the transverse engaging rod 62 engages the selected aligned pair of the engaging grooves 75, 76, 77 of the regulating seats 7 and abuts against the rear side walls 79 of the regulating seats 7 to support the backrest frame 5 at a desired inclination relative to the seat frame 4.

FIGS. 2 and 3 illustrate the chair frame of the preferred embodiment when the transverse engaging rod 62 engages a lowermost pair of the engaging grooves 75 of the regulating seats 7. At this time, the backrest frame 5 forms a largest angle with the seat frame 4. When the transverse engaging rod 62 engages an uppermost pair of the engaging grooves 77 of the regulating seats 7, the backrest frame 5 forms a smallest angle with the seat frame 4.

Figure 4:
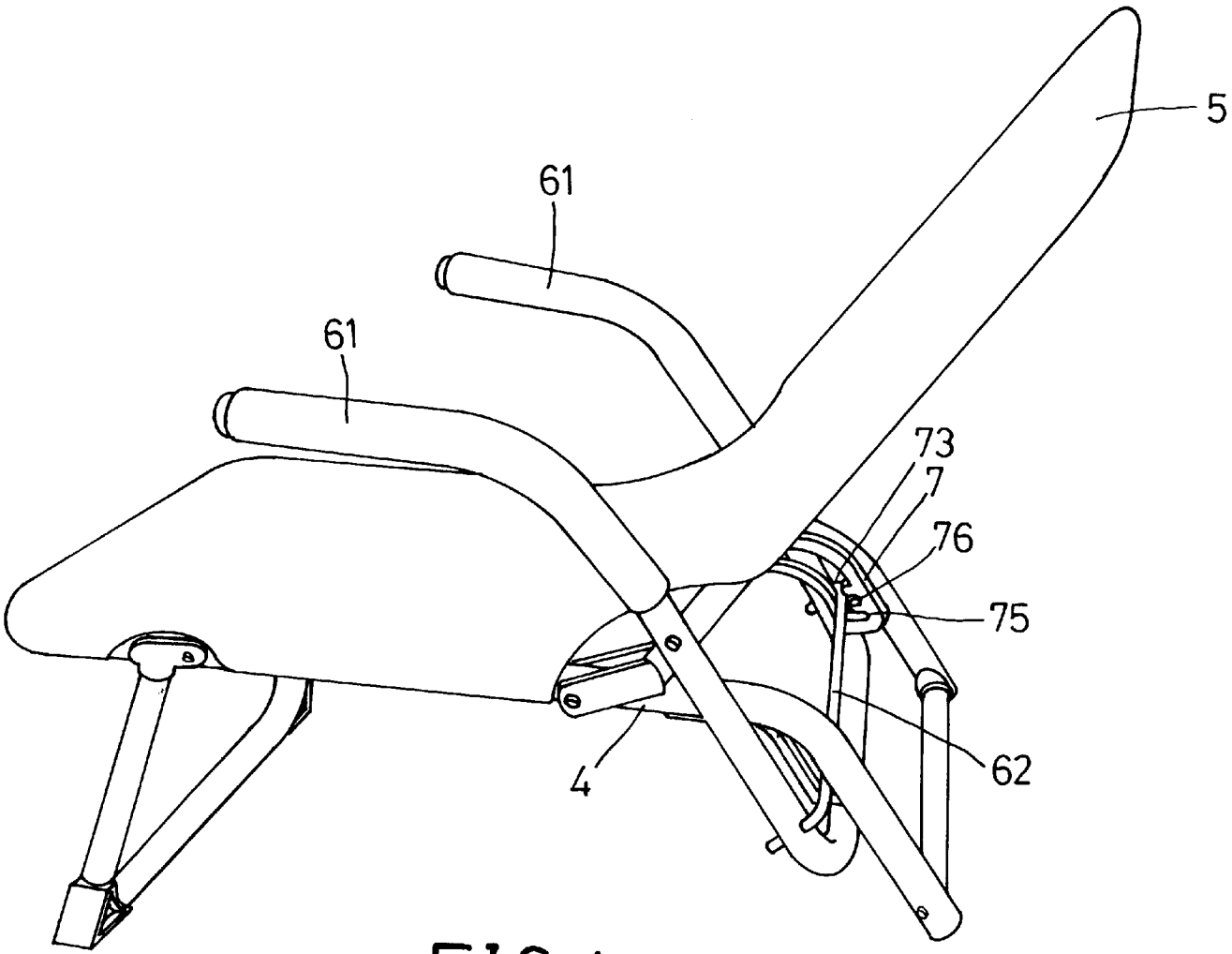
FIG. 4 is a perspective view of the preferred embodiment illustrating operation of an armrest frame for adjusting inclination of a backrest frame.
Figure 5:
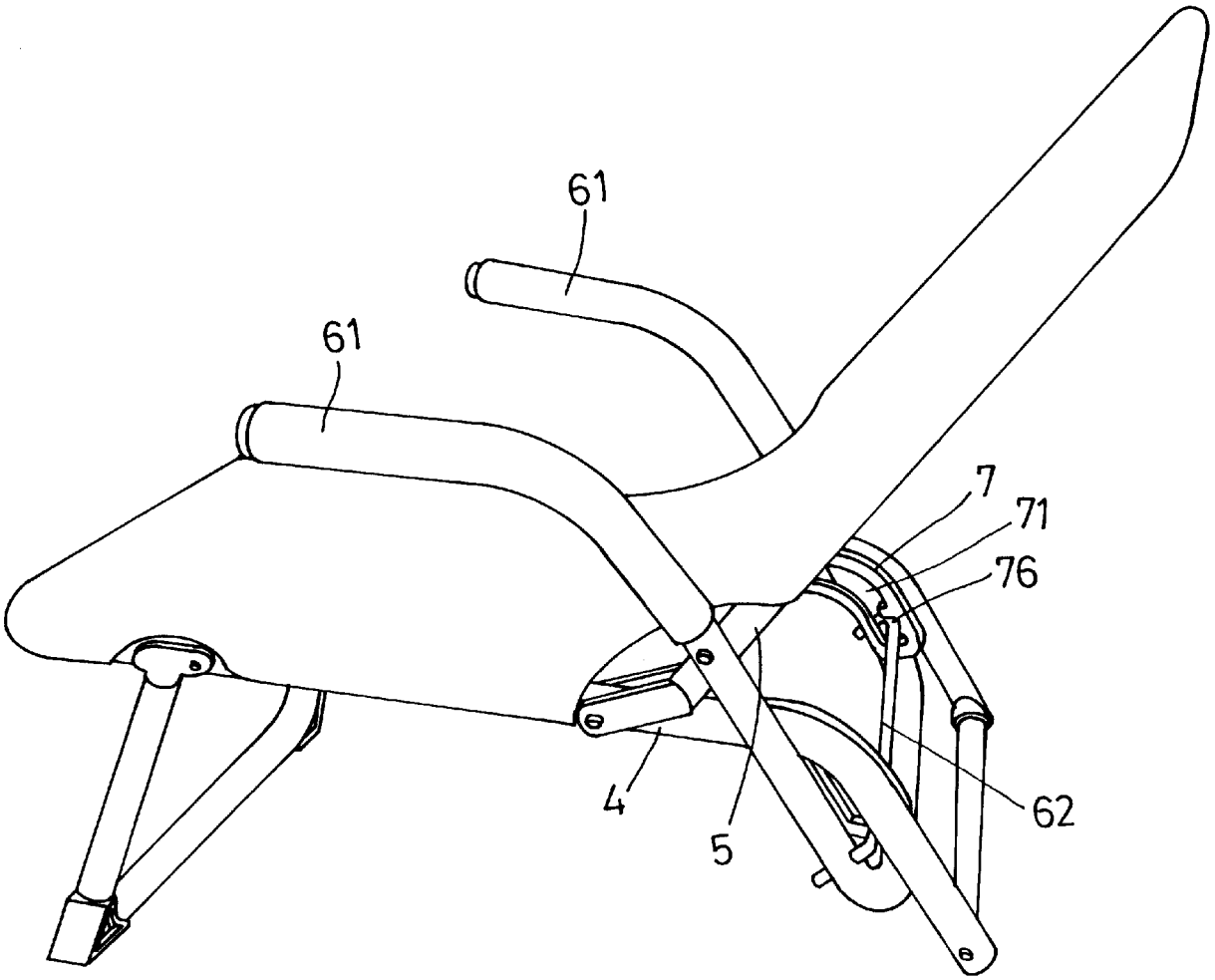
FIG. 5 is a perspective view of the preferred embodiment when the backrest frame is adjusted to have a different inclination from that in FIG. 2.

Referring to FIGS. 4 and 5, when it is desired to adjust the inclination of the backrest frame 5 so that the backrest frame 5 pivots forwardly toward the seat frame 5, for example, from the state shown in FIG. 2 to the state shown in FIG. 5, the armrest bars 61 are pulled forwardly by the user, with the user leaning forward while seated on the chair constructed by the chair frame, to disengage the transverse engaging rod 62 from the lowermost engaging grooves 75 and to permit movement of the transverse engaging rod 62 in the elongated slots 71 of the regulating seats 7 (see FIG. 4). When the transverse engaging rod 62 moves along the second sections 73 of the elongated slots 71 to a position adjacent to the middle pair of engaging grooves 76, the armrest bars 61 are pushed rearwardly to engage the transverse engaging rod 62 within the engaging grooves 76. Thus, the adjustment operation can be completed without the need for the user to get up from the chair.

Figure 6:
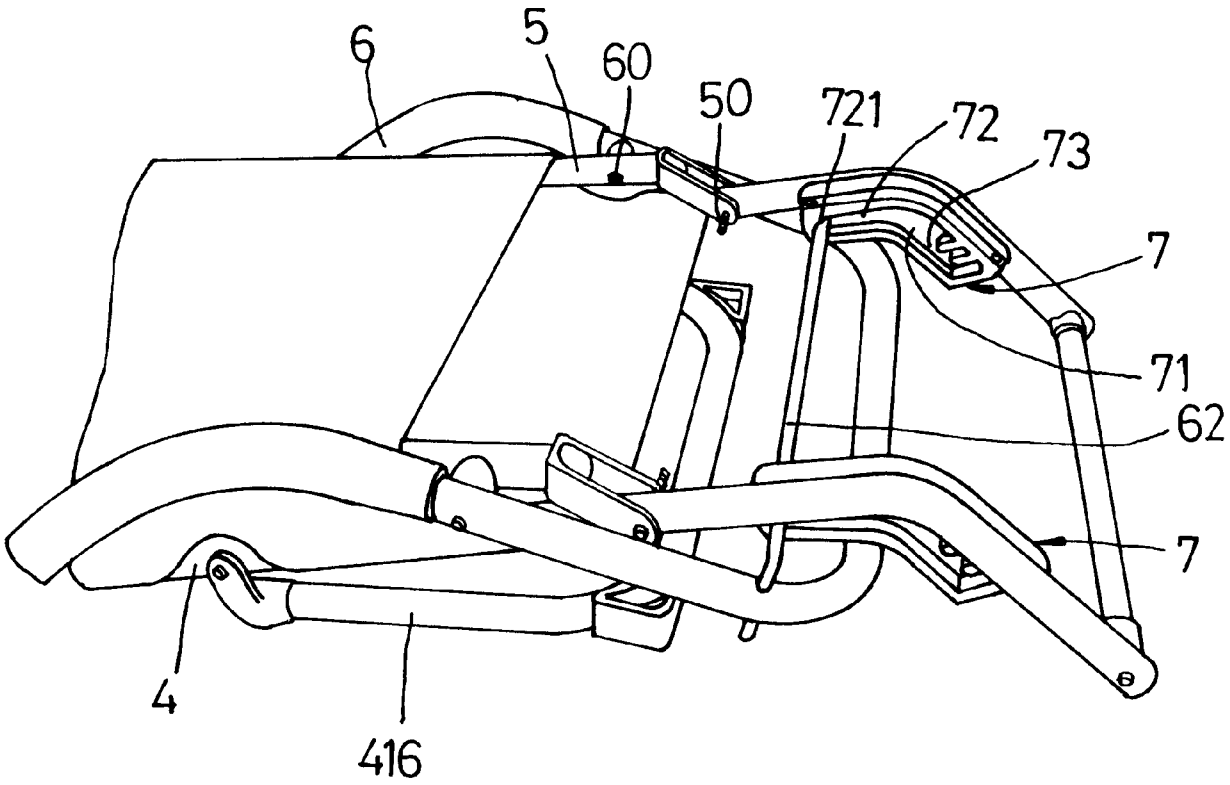
FIG. 6 is a fragmentary perspective view of the preferred embodiment when folded.

Referring to FIG. 6, to fold the chair frame for storage or transport, the armrest bars 61 are pulled forwardly to move the transverse engaging rod 62 to the first position so that the transverse engaging rod 62 can be extended into the first sections 72 of the elongated slots 71 to abut against front end walls 721 of the regulating seats 7. At this time, the backrest frame 5 can be folded onto the seat frame 4 about the first pivot shaft 50, and the armrest frame 6 can be folded onto the backrest frame 5 about the second pivot shaft 60. Then, the front leg frame 416 is turned rearwardly relative to the seat frame 4 for folding on the same. Folding of the chair frame is thus completed.

It has thus been shown that, by merely pulling forward and pushing rearward the armrest frame 6 to disengage and then engage the transverse engaging rod 62 with the engaging grooves 75, 76, 77 of the regulating seats 7, the inclination of the backrest frame 5 of the chair frame of the present invention can be easily adjusted. In addition, the user need not get up from the chair before conducting the adjustment operation. The object of the present invention is thus met.

With this invention thus explained, it is apparent that numerous modifications and variations can be made without departing from the scope and spirit of this invention. It is therefore intended that this invention be limited only as indicated in the appended claims.

I claim:

1. A chair frame, comprising:

a backrest frame having a lower end portion;

a substantially horizontal seat frame having a rear end portion pivoted to said lower end portion of said backrest frame about a first pivot axis, and a front end portion;

a rear leg frame extending downwardly from said rear end portion of said seat frame;

a front leg frame extending downwardly from said front end portion of said seat frame;

a regulating seat mounted on said rear leg frame, said regulating seat having two opposite side walls that define an elongated slot therebetween, one of said side walls being formed with a plurality of engaging grooves that open toward said elongated slot; and a movable armrest frame having a front section that extends forwardly of said backrest frame, and a rear section that extends rearwardly and downwardly of said backrest frame and that is pivoted to said backrest frame about a second pivot axis above said first pivot axis, said rear section of said armrest frame being provided with an engaging member that is disposed adjacent to said rear leg frame and that extends slidably into said elongated slot of said regulating seat for engaging a selected one of said engaging grooves, said armrest frame being operable to move said engaging member between a first position, in which said engaging member is movable along said elongated slot to permit forward and rearward pivoting movement of said backrest frame about said first pivot axis, and a second position, in which said engaging member engages the selected one of said engaging grooves to support said backrest frame at a desired inclination relative to said seat frame.

2. The chair frame according to claim 1, wherein said front leg frame has an upper end mounted pivotally to said front end portion of said seat frame to permit folding of said front leg frame relative to said seat frame.

3. The chair frame according to claim 1, wherein said armrest frame includes a pair of armrest bars disposed on opposite sides of said backrest frame, said engaging member being formed as a transverse engaging rod which interconnects rear sections of said armrest bars.

4. The chair frame according to claim 3, wherein said side walls of said regulating seat include a front side wall and a rear side wall, said engaging grooves being formed on said rear side wall and opening toward said front side wall, said transverse engaging rod being disposed anteriorly of said rear leg frame and abutting against said rear side wall when said engaging rod is in the second position.

5. The chair frame according to claim 3, wherein said elongated slot of said regulating seat includes a first section extending in a direction along said seat frame, and a second section extending in a direction along said rear leg frame, said engaging grooves being formed on said second section, said transverse engaging rod extending into said first section when said backrest frame is folded onto said seat frame.

* * * * *